United States Patent [19]

Gregory

[11] Patent Number: 4,653,308

[45] Date of Patent: Mar. 31, 1987

[54] ADJUSTABLE LEVER OPERATED RIVETER

[75] Inventor: Jack T. Gregory, Penngrove, Calif.

[73] Assignee: The Gregory Company, Rohnert Park, Calif.

[21] Appl. No.: 795,989

[22] Filed: Nov. 6, 1985

[51] Int. Cl.[4] ..... B21D 31/00

[52] U.S. Cl. ..... 72/391; 72/409; 81/356

[58] Field of Search ..... 72/391, 409, 114, 453.17; 29/243.53, 268; 227/55; 81/9.41, 362, 355, 356

[56] References Cited

U.S. PATENT DOCUMENTS

| | | | |
|---|---|---|---|
| 2,399,442 | 4/1946 | Luce | 72/391 |
| 3,328,985 | 7/1967 | Keymer | 72/391 |
| 3,548,627 | 12/1970 | Henshaw | 72/391 |
| 4,425,782 | 1/1984 | Todisco | 72/114 X |
| 4,520,648 | 6/1985 | Gregory | 72/391 |

FOREIGN PATENT DOCUMENTS

| | | | |
|---|---|---|---|
| 2739166 | 3/1979 | Fed. Rep. of Germany | 29/268 |

*Primary Examiner*—Howard N. Goldberg
*Assistant Examiner*—Taylor J. Ross
*Attorney, Agent, or Firm*—Melvin R. Stidham

[57] ABSTRACT

The disclosure is of a mechanical riveter wherein rivet-gripping jaws are pulled through a slideway by means of a pull rod. Each of a pair of links is pivoted between one of a pair of squeezable handles and a yoke carried on the pull rod. Means are provided to adjust the position of the yoke along the rod, thus fixing the length of the stroke and the mechanical advantage of the tool.

3 Claims, 4 Drawing Figures

ADJUSTABLE LEVER OPERATED RIVETER

BACKGROUND OF THE INVENTION

There are presently available lever operated riveters of the type shown in my U.S. Pat. No. 4,520,648 granted June 4, 1985, wherein a blind rivet is set by squeezing a pair of handles on the tool to pull the stem or shank of the rivet through a predetermined stroke, which is sufficient to tightly clamp overlapped work pieces and then sever the stem from the set rivet. While such mechanical riveters are very effective in setting blind rivets that are relatively low in tensile strength, such as plastic rivets, the linkages of such mechanical tool sometimes do not provide sufficient mechanical advantage to set and sever a rivet of relatively high tensile stength.

OBJECTS OF THE INVENTION

It is an object of this invention to provide a manually operated, mechanical riveter that has adjustable leverage, enabling one to increase the mechanical advantage in accordance with the tensile strength of the rivet to be pulled.

It is a further object of this invention to provide a mechanical riveter that can be operated with one hand.

It is a further object of this invention to provide a manually operated mechanical riveter that can set and sever the stem of a light, relatively weak rivet with a single stroke or set and sever a relatively strong rivet with a series of short strokes at high mechanical advantage.

Other objects and advantages of this invention will become apparent from the description to follow, particularly when read in conjunction with the accompanying drawing.

SUMMARY OF THE INVENTION

The mechanical riveter of this invention includes a pulling rod that pulls rivet-gripping jaws axially through a slideway. A link is pivoted between each of a pair of squeezable handles and one side of a yoke carried on the pulling rod. As the handles are squeezed, the yoke is pushed back by the links, and the mechanical advantage of the tool increases progressively as the handles approach a parallel relationship. A nut threaded onto the pulling rod adjusts the position of the yoke along the pulling rod to set the length of stroke. The closer the handles are together at the start, i.e. more nearly parallel, the greater the initial mechanical advantage, but the shorter the length of the working stroke. For a relatively weak rivet, sch as one of plastic, the yoke may be set forward, spreading the links and handles outward to increase the length of the stroke and allowing the plastic rivet to be severed in a single squeeze. With a strong rivet, the nut may be threaded back to bring the handles closer together to provide greater leverage. However, more than one stroke may be required to set such a rivet and sever the stem therefrom.

DESCRIPTION OF A PREFERRED EMBODIMENT

Figure 1:
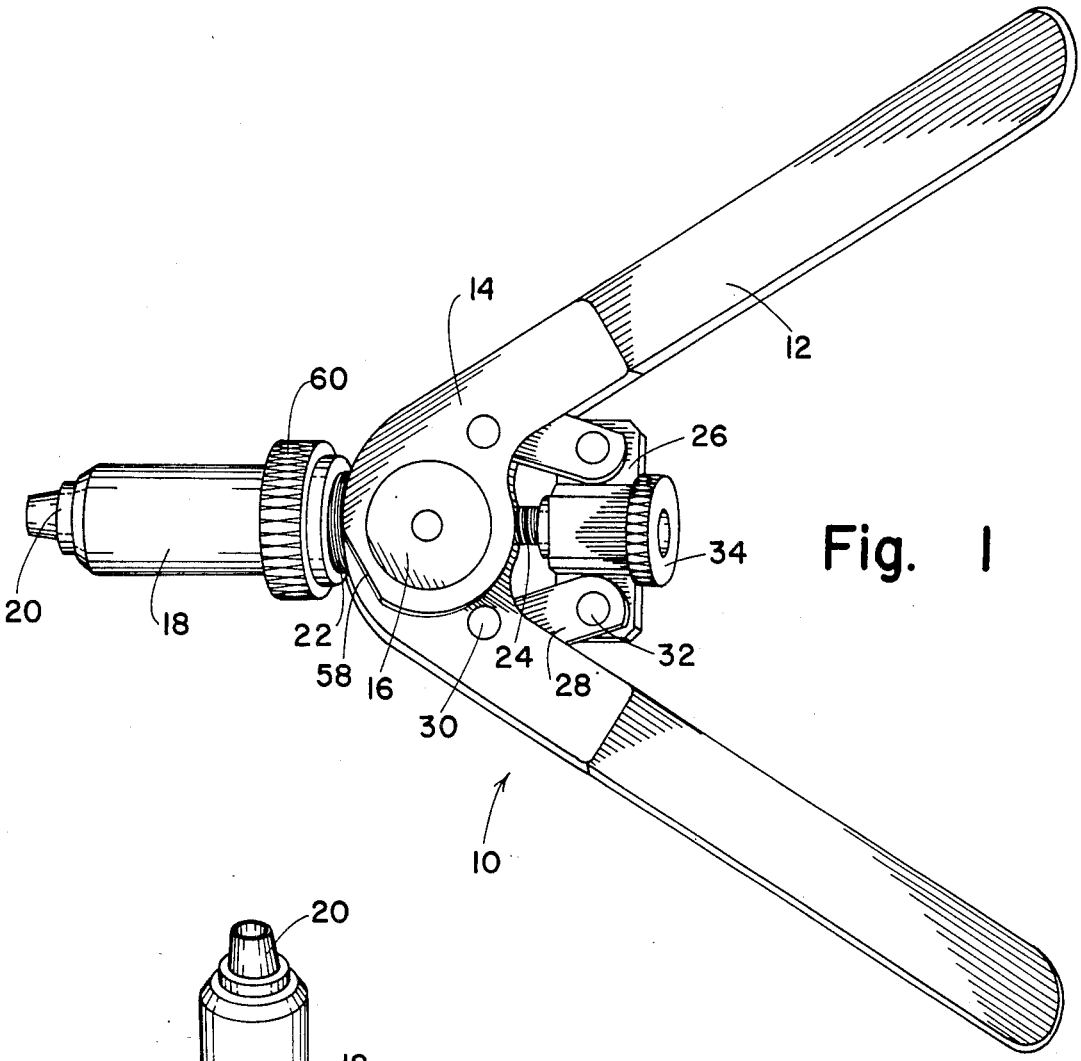
FIG. 1 is a view in perspective taken from the side and rear of the mechanical riveter of this invention.
Figure 2:
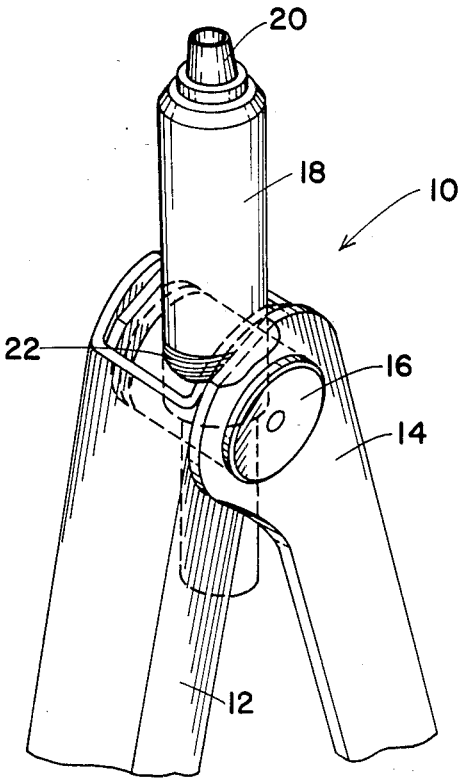
FIG. 2 is a partial view in perspective taken from above the riveter.

Referring now to FIGS. 1 and 2 with greater particularity, the riveter 10 of this invention includes a pair of squeezable handles 12, with interleaving channel portions 14 rotatably carried on a cylindrical axle 16. A cylindrical barrel or slideway 18, which carries a nose piece 20, is inserted into a radial counterbore 22 through the axle 16 as by threading it in, and when in place, the barrel 18 prevents the straddling arms from becoming disengaged from the axle 16, as shown in FIG. 2.

Rivet-pulling jaws, hereinafter to be described, are carried on a pull rod 24 extending co-axially through the cylindrical barrel 18 and radially through the axle 16. A yoke 26 is movable along the pull rod 24, and each of a pair of links 28 is pivoted at 30 to a handle 12 and at 32 to one side of the yoke 26. A nut 34 threaded on the pull rod 24 may be rotated to adjust the initial position of the handles and, hence, the length of the pulling stroke. For example, if the nut is rotated to push the yoke to the left in FIG. 1, the arms 12 will be spread further apart to increase the length of the stroke, but to reduce the mechanical advantage in squeezing the handles. Conversely, for greater leverage, the nut may be threaded to pull the yoke to the right and, hence, to pull the handles 12 closer together. This, in turn, shortens the working stroke of the yoke 26.

Figure 3:
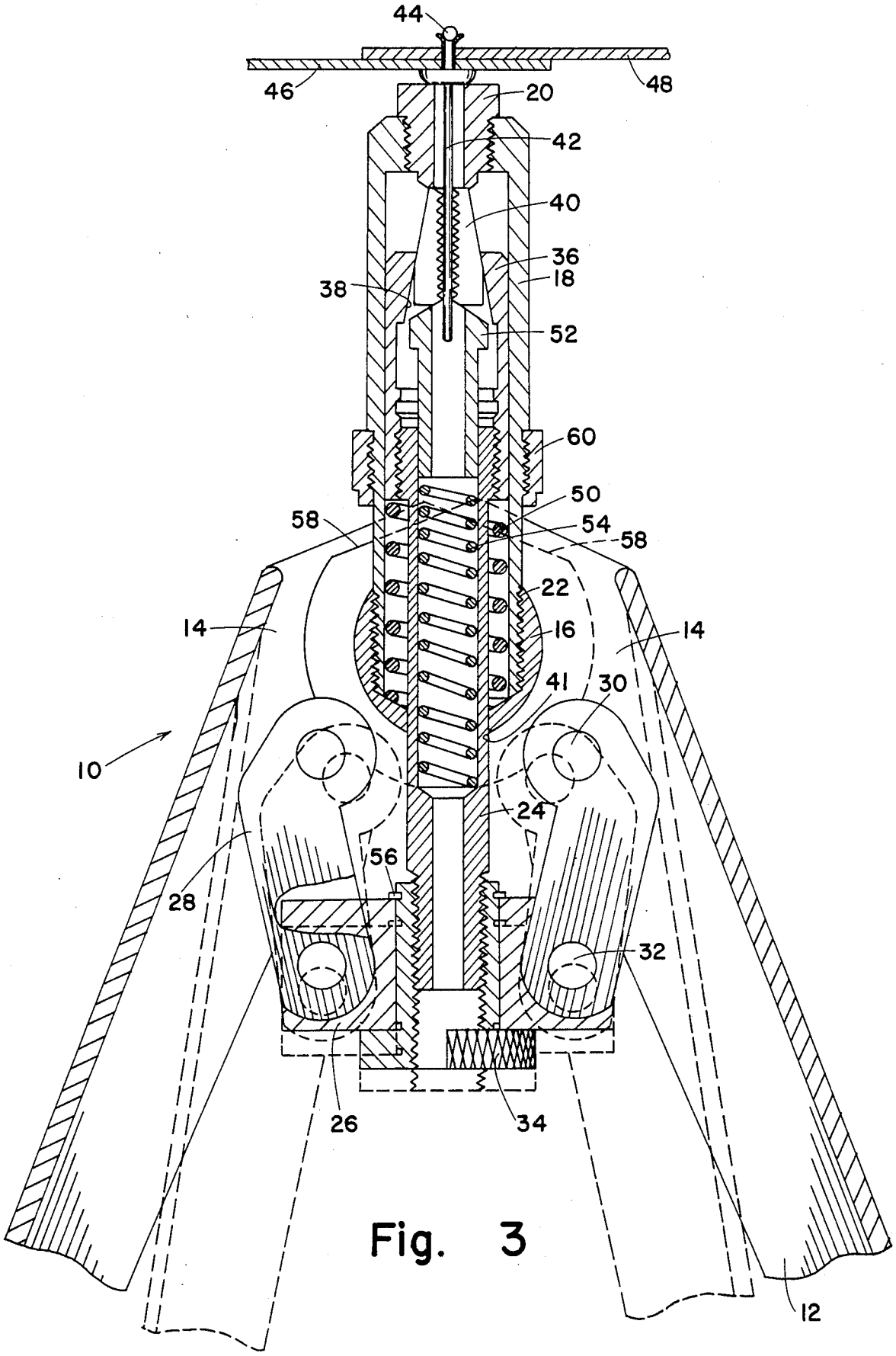
FIG. 3 is a vertical section view of the riveter in its initial position.
Figure 4:
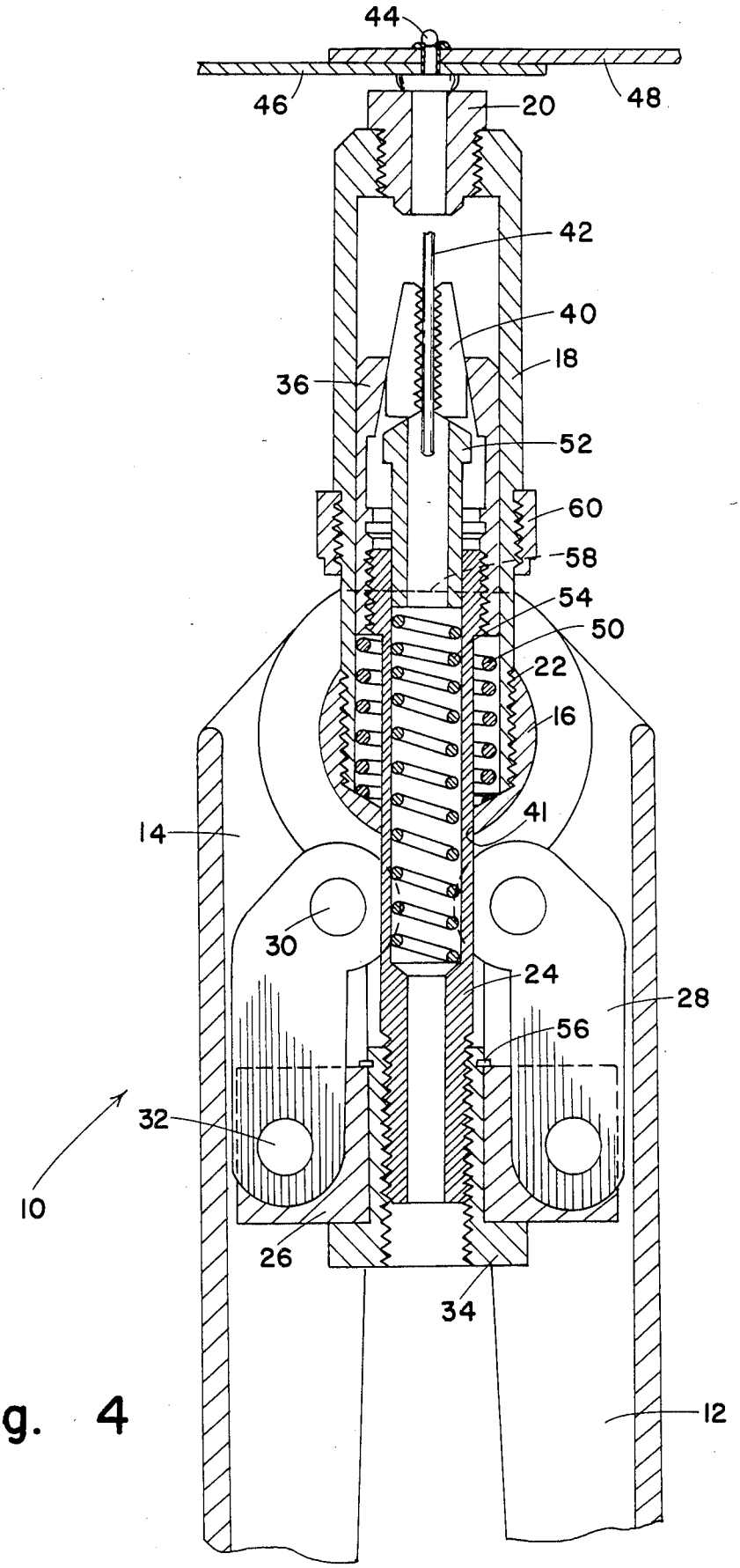
FIG. 4 is a vertical section view of the riveter at completion of its stroke.

Referring now to FIGS. 3 and 4, there is slidably carried within the cylindrical barrel or slideway 18, a collar 36 having a conical inner surface 38 that engages the conical outer surfaces of a set of two or more jaw segments 40. It is apparent that, as the collar 36 is pulled down by pulling the rod 24 through the bore 41 in the axle 16, the jaws 40 are forced together to clamp the shank 42 of a rivet 44 and then pull it downward. In setting a rivet, the jaws pull a nodule through a sleeve, to spread the sleeve outward and roll its walls over, thus, securing the workpieces 46 and 48 firmly together. The conical collar 36 is biased to its upper position in FIGS. 3 and 4 by a strong spring 50.

A tubular jaw pusher 52 is biased upward by a spring 54 to force the jaw segments 40 up against the conical surface of the collar 36 and firmly set the grip on the rivet stem 42. The jaw pusher 52 and pulling rod 24 are of tubular configuration so that when the rivet shank 42 is severed, it will simply drop down through the jaw pusher 52 and out the bottom of the pulling rod 24. When the handles 12 are released after a pull and the strong spring 50 returns the jaws 40 to the nose piece 20, the jaws are spaced to release the rivet shank 42. If the shank 43 has been severed, it will simply drop as described. It it has not been severed the jaws 40 will take a new grip preparatory to another pull.

As shown, the yoke or rod puller 26 is movable along the pulling rod 24, and the positioning nut 34, which is clipped at 56 to the yoke 26, is threaded onto the rod 24 to adjust the starting position of the mechanical riveter 10 of this invention.

For example, with a rivet that is relatively easily severed, the operator may wish to sacrifice mechanical advantage for speed and set the adjustment nut 34 in an upper position, as shown in solid lines, so that the handles 12 and 14 are spread relatively far apart. From this upper position, it requires a longer stroke to bring the handles of the tool 10 to their fully closed positions shown in FIG. 4, enabling the tool 10 to set a rivet 44 and sever the stem 42 in a single stroke. On the other hand, the relatively wide spread of the handles 12 and 14, with reduced mechanical advantage, may make it rather difficult for the operator to sever a strong rivet, such as one of steel. In such case, he may then thread the adjustment nut 34 to the position shown in phantom, bringing the handles 12 and 14 closer together enabling them to be squeezed more easily with one hand operation. If in such event, the length of the stroke is not sufficient to completely set the rivet, the operator may simply release his grip on the handles and allow the collar 36 to be returned to initial position by means of the relatively strong spring 50. This enables the jaws 40 to take a new grip on the rivet shank 42. Thereafter, the operator squeezes the handles 12 again to effect a further stroke. This may be repeated until the rivet is completely set and severed.

When the operator is through with the tool, he may squeeze the handles 12 together to the position shown in FIG. 4 wherein flat surfaces 58 on the ends of the handles 12 are disposed in a radial plane of the cylindrical barrel 18. Then, a locking nut 60 on the outside of the barrel 18 may be threaded down to engage the flat surfaces 58 and hold the handles 12 and 14 in their fully closed position, making the tool 10 easier to carry in a pocket, tool chest or the like.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A mechanical pulling tool comprising:

a slideway;

a nosepiece on one end of said slideway to press against a surface;

a gripping member slidable along said slideway to pull a member away from said surface;

a pull rod carrying said gripping member at one end thereof and extending rearward with the other end thereof being located beyond the other end of said slideway;

a pair of squeezable handles pivoted about a common axis on said other end of said slideway;

a rod puller movable along said rod near said other end thereof;

said rod puller comprising a yoke having a diametrically opposed pair of arms extending radially therefrom;

a pair of links, each pivoted at one end to one of said handles near said common axis, and extending inward and rearward to pivot at the other end thereof to one of said yoke arms so that squeezing said handles extends said links to push said rod puller rearward;

said pull rod being threaded from said other end thereof; and adjustment means threaded on and movable along said pull rod to position said rod puller along said rod to set the length of stroke of said rod produced by squeezing said handles.

2. The mechanical pulling tool defined by claim 1 including: a return spring biasing said gripping member toward said nosepiece.

3. A mechanical pulling tool comprising:

a generally cylindrical axle;

a pair of squeezable handles overlapped and rotatably mounted on said axle;

means forming coaxial, radial bore and counterbore through said axle;

a pull rod slidably received in said bore;

a slideway secured in said counterbore to extend forward therefrom;

said slideway preventing dislodgement of said handles from said axle;

a gripping member carried on one end of said pull rod and extending into said slideway;

a yoke movable along said pull rod near the other end thereof and having a pair of diametrically opposed arms extend radially therefrom;

means on said yoke threadedly engaging said rod adjacent said other end thereof to adjust the initial position of said yoke along said rod; and a pair of links, each pivoted at one end to one of said handles near said axle, and extending inward of said handles and rearward of said axle to pivot at the other end thereof to one of said yoke arms so that squeezing said handles extends said links to push said yoke rearward.

* * * * *